US005598948A

United States Patent [19]

Rizer

[11] Patent Number: 5,598,948

[45] Date of Patent: Feb. 4, 1997

[54] FASTENER DISPENSER

[75] Inventor: Brooks Rizer, Dalton, Ga.

[73] Assignee: Textile & Industrial Sales, Inc., Dalton, Ga.

[21] Appl. No.: 443,724

[22] Filed: May 18, 1995

[51] Int. Cl.[6] ..... B65H 1/00

[52] U.S. Cl. ..... 221/198; 227/67

[58] Field of Search ..... 221/197, 198, 221/268, 271; 227/67, 147, 120, 130

[56] References Cited

U.S. PATENT DOCUMENTS

| | | | |
|---|---|---|---|
| 4,013,207 | 3/1977 | ErkenBrack | 227/120 |
| 4,288,017 | 9/1981 | Russell | 227/67 |
| 4,627,563 | 12/1986 | Meyer | 227/130 |
| 4,648,531 | 3/1987 | Won | 221/198 |
| 4,781,318 | 11/1988 | Meyers | 227/67 |
| 4,860,937 | 8/1989 | Arnold | 227/147 |
| 4,932,580 | 6/1990 | Pfister et al. | 227/10 |
| 5,024,365 | 6/1991 | Bourque | 227/67 |
| 5,163,596 | 11/1992 | Ravoo et al. | 227/109 |

OTHER PUBLICATIONS

Product Brochure of The Avery Dennison Fastener Division, Framingham, Massachusetts.

Photograph of a Dennison fastener.

*Primary Examiner*—Kenneth Noland

*Attorney, Agent, or Firm*—Jones & Askew

[57] ABSTRACT

A dispenser for applying dual head fasteners from a fastener stock which comprises a plurality of fasteners attached to a runner bar such that the fasteners extend outwardly from the runner bar substantially parallel with one another and substantially perpendicular to the runner bar. The first heads are side-by-side and have longitudinal axes substantially perpendicular to the longitudinal axis of the runner bar, and the second heads are side-by-side. The dispenser comprises an actuator, a magazine for feeding fasteners from the fastener stock to the actuator, and a slide assembly for moving the fastener stock through the magazine and actuator. The actuator comprises a hollow slotted needle and a reciprocating plunger for dispensing the fasteners through the hollow slotted needle. The magazine comprises an elongate guide member defining a chute having an elongate slotted runner passage for receiving the runner bar of the fastener stock and an elongate slotted head passage for receiving first heads of the fasteners as the fastener stock is fed through the magazine. The dispenser may also include a presser foot.

25 Claims, 8 Drawing Sheets

FASTENER DISPENSER

TECHNICAL FIELD

This invention relates to machines for dispensing dual head plastic fasteners to connect objects. More particularly, this invention relates to machines for dispensing dual head fasteners from a fastener stock comprising a plurality of the dual head fasteners severably attached to a runner bar.

BACKGROUND OF THE INVENTION

Flexible plastic fasteners known as dual head fasteners are useful for joining objects together. For example, dual head fasteners are used in attaching tags or labels to textile products such as clothing, rugs, mats, towels, and the like. Dual head fasteners comprise a pair of heads connected by a filament that runs perpendicularly between the heads. Typically, one of the heads is shaped like a bar and the other of the heads is shaped like a paddle. Dual head fasteners are dispensed by ejecting the bar-shaped head of the fastener through a hollow slotted needle which penetrates the objects to be joined.

Dual head fasteners are supplied in the form of a stock comprising a plurality of severably connected fasteners. There are two types of fastener stocks. One type comprises a plurality of fasteners connected in series with the heads attached end-to-end. Another type of fastener stock comprises a plurality of fasteners attached by means of severable necks to a runner bar with the respective heads positioned side-by-side.

Dispensers for both types of fastener stocks described above typically have a fastener feed mechanism comprising a system of wheels, ratchets, and springs. Although such dispensers have been effective, the feed mechanism is relatively complicated and fragile and tend to jam or otherwise fail. In addition, most of the dispensers are hand-held and are activated with a hand trigger. Operators of such hand-held dispensers have had problems with carpel tunnel syndrome.

Accordingly, there is a need for a simpler, more reliable, easy-to-use, dual head fastener dispenser, particularly a dispenser that applies dual head fasteners from a fastener stock wherein the fasteners are severably attached to a runner bar.

SUMMARY OF THE INVENTION

This invention fulfills the above-described needs by providing an apparatus for dispensing dual head fasteners from a fastener stock comprising a plurality of the fasteners removably attached to a runner bar with severable necks connecting respective first heads of the fasteners to the runner bar opposite the filaments of the fasteners so that (1) the fasteners extend outwardly from the runner bar substantially parallel with one another and substantially perpendicular to the runner bar, (2) the first heads are side-by-side and have longitudinal axes substantially perpendicular to the longitudinal axis of the runner bar, and (3) the second heads of the fasteners are positioned side-by-side. The dual head fasteners are typical dual head fasteners comprising a first head, a second head, and a filament connecting the first and second heads so that the first and second heads are substantially parallel to one another and the filament is substantially perpendicular to the first and second heads.

Generally described, the dispensing apparatus comprises an actuator for applying the fasteners to a workpiece such as a textile product, a magazine for feeding fasteners from the fastener stock to the actuator, and a slide assembly for forcing the fasteners through the magazine into the actuator.

The actuator comprises a hollow slotted needle mounted to a casing and a plunger disposed in the casing for reciprocation within the needle. The casing has a plunger passage extending along a longitudinal axis of a casing and a fastener port proximate one end of the casing for receiving the first heads of the fasteners. The hollow slotted needle has an elongate slotted needle passage having a slot and an inlet and an outlet. The needle is fixed to the casing so that the inlet of the needle communicates with the port and the needle extends from one end of the casing toward the needle outlet along a longitudinal axis substantially parallel to the longitudinal axis of the casing. The plunger is disposed in the plunger passage and is extendable into the slotted needle passage by a reciprocating device for reciprocation within the plunger passage and the slotted needle passage for ejecting the first heads of the fasteners through the outlet of the needle.

The magazine for the dispenser comprises an elongate guide member extending laterally from the actuator casing at the port and defines a chute having an elongate slotted runner passage for receiving the runner bar of the fastener stock and an elongate slotted head passage for receiving the first heads of the fasteners. The slotted runner passage of the magazine is in communication with the port and has a slot through which the severable necks of the fastener stock project. The slotted head passage is in communication with the port of the casing and has a slot through which the filaments of the fasteners project.

The slide assembly comprises a slide including a foot selectively and slidably engagable in the slotted head passage and alternatively removable from the slotted head passage. The slide assembly further comprises a spring for forcing the foot through the slotted head passage and against the fastener stock to force the fasteners into the casing port for dispensing fasteners through the hollow slotted needle.

Desirably, the casing of the dispenser has an elongate slotted runner passage having a slot and extending through the casing at the port substantially perpendicularly to the longitudinal axis of the casing for receiving the runner bar of the fastener stock such that the severable necks protrude through the slot of the slotted runner passage in the casing. The slotted runner passages of the magazine and casing are aligned with one another at the port of the casing so that the runner bar can be fed from the magazine and through the casing.

More particularly, the slide of the dispenser further comprises a neck which projects through the slot of the slotted head passage when the foot is engaged in the slotted head passage and the slide assembly further comprises a carriage for carrying the slide as the slide is moved through the slotted head passage. The neck of the slide is connected to the carriage. Furthermore, the magazine desirably further comprises (a) a pair of brackets extending from the elongate guide member spaced from one another and opposite the chute and (b) a guide bar extending between the bracket wherein the guide bar is slidably engaged with the carriage for guiding the carriage as the carriage moves along the magazine.

Preferably, the carriage further comprises a pivotable bearing and a lever arm pivotably mounted on one end to the actuator mechanism and extending through a bore in the pivotable bearing to another end. The spring is attached at one end to the actuator and at the other end to the lever arm between the ends of the lever arm so that the spring forces the lever arm, carriage, and slide toward the actuator. Desirably, the spring extends from the lever arm to the actuator at an acute angle to the lever arm and in a direction away from the magazine.

More particularly, the dispenser further comprises a presser foot mounted to the actuator casing and comprising a ring positioned so that the hollow slotted needle passes through the ring when the needle is reciprocated.

Accordingly, an object of the present invention is to provide an improved dual head fastener dispenser.

Another object of the present invention is to provide a simpler, more reliable dual head fastener dispenser.

Still another object of the present invention is to provide a dual head fastener dispenser that is stationary and easily operated.

Other objects, features and advantages of the present invention will become apparent from the following detailed description, drawings, and claims.

DETAILED DESCRIPTION OF DRAWINGS

Figure 1:
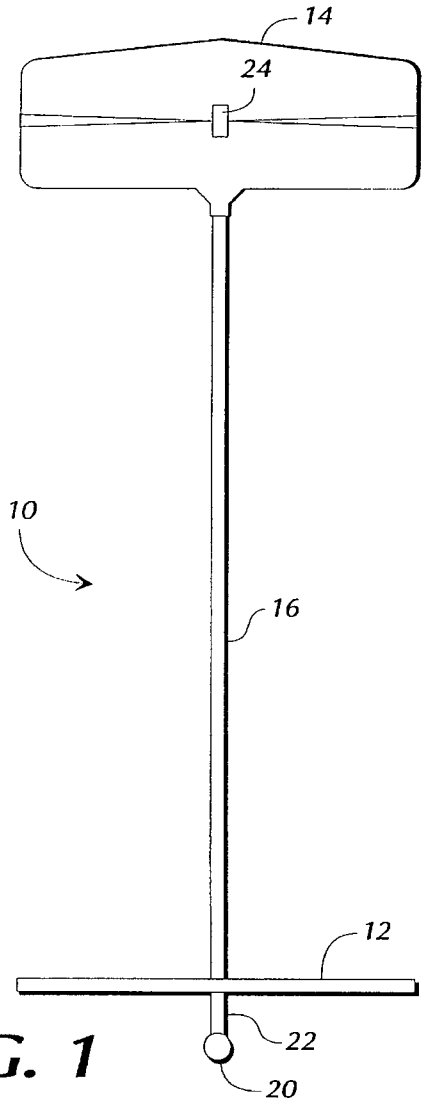
FIG. 1 is an elevation view of a dual head plastic fastener suitable for application with a dispenser made in accordance with the present invention.
Figure 3:
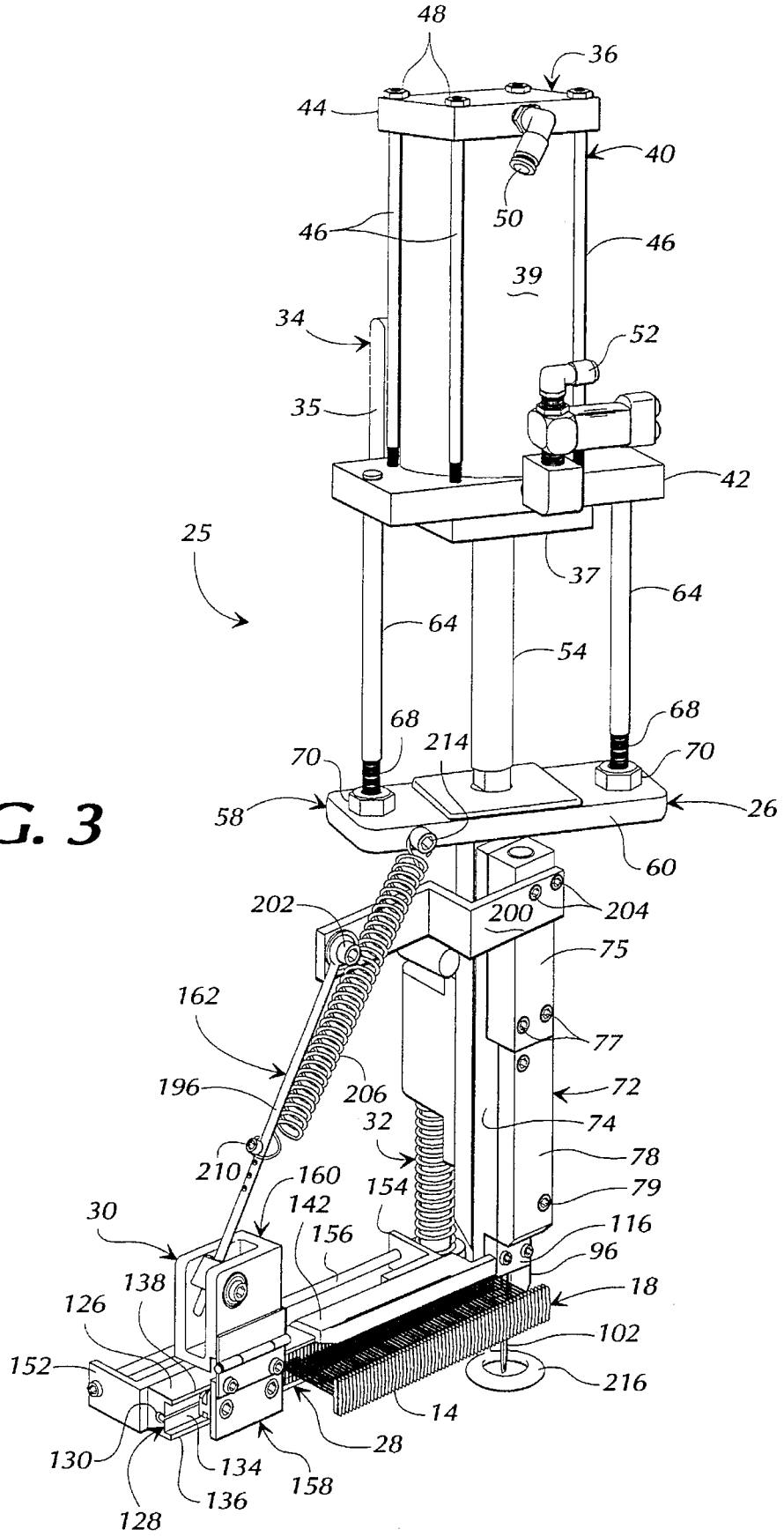
FIG. 3 is a perspective view of a fastener dispenser made in accordance with an embodiment of the present invention.
Figure 4:
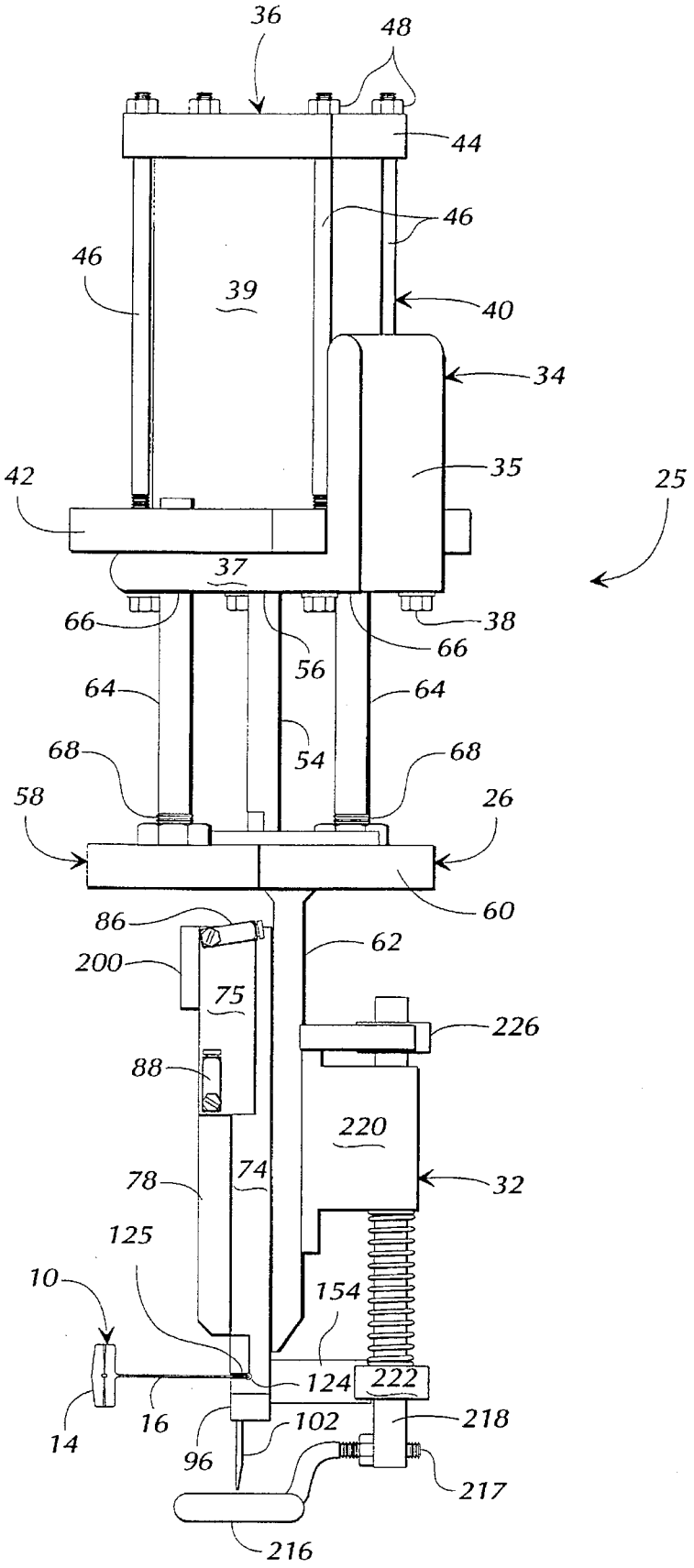
FIG. 4 is a side elevation view of the embodiment shown in FIG. 3 illustrating the side of the dispenser opposite the fastener magazine.

As summarized above, the present invention is an apparatus for dispensing dual head fasteners, one of which fasteners is shown at 10 in FIG. 1. As can be seen, the dual head fastener 10 comprises a first head 12 and a second head 14 connected by a filament 16. The first head 12 has the shape of an elongate bar having a substantially circular cross section and the second head 14 has the shape of a paddle. The first and second heads 13 and 14 are integrally attached to opposite ends of the filament 16 so that the first and second heads are parallel to one another and perpendicular to the filament.

Figure 2:
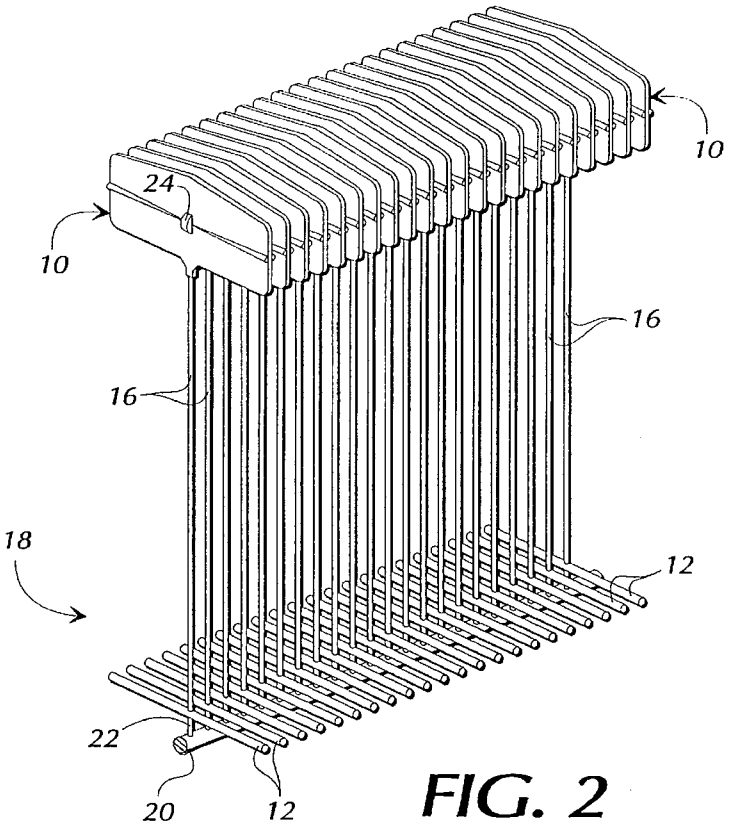
FIG. 2 is a perspective view of a fastener stock from which fasteners may be dispensed using the dispenser of the present invention.

The dispensing apparatus of the present invention is particularly suitable for dispensing the dual head fastener 10 from a fastener stock 18 of the type shown in FIG. 2 and comprising a plurality of the fasteners removably attached to a runner bar 20 with respective severable necks 22. The severable necks 22 extend from the first heads 12 of the fasteners 10 to the runner bar 20 opposite the filament 16 of the fasteners. The fasteners 10 extend outwardly from the runner bar 20 substantially parallel with one another and substantially perpendicular to the runner bar 20 which has a longitudinal axis. The first heads 12 of the filaments 10 are positioned side-by-side and have longitudinal axes substantially perpendicular to the longitudinal axis of the runner bar 20. In addition, the second heads 14 of the fasteners 10 are positioned side-by-side and connected by severable connectors 24. Desirably, the entire fastener stock 18 is an integral unit made of a plastic such as polypropylene.

An apparatus 25 made in accordance with an embodiment of the present invention for dispensing dual head fasteners 10 from the fastener stock 18 described above is shown in FIGS. 3–5 and 8–10. Generally, the fastener dispenser 25 comprises an actuator 26 for applying the fasteners to a textile product or other workpiece, a magazine 28 for feeding the fasteners to the actuator, a slide assembly 30 for forcing the fastener stock 18 through the magazine, and a presser foot assembly 32 for aiming the actuator and holding the workpiece taut.

The actuator 26 comprises a frame including an L-shaped mounting bracket 34 for stationary mounting of the dispenser 25. The L-shaped bracket 34 has a rearward panel 35 with a plurality of bores extending therethrough for receiving mounting bolts for mounting the actuator 26 to an object such as a work table. A pneumatic drive 36 is mounted to the top of the lower panel 37 of the mounting bracket 34 with four bolts 38.

The pneumatic drive 36 includes a pneumatic cylinder 39 disposed in a frame 40. The pneumatic cylinder 39 is disposed between the lower plate 42 and upper plate 44 of the frame 40. The lower plate 42 of the frame is mounted to the L-shape bracket 34 with the four bolts 38. The lower plate 42 and the upper plate 44 of the pneumatic drive frame 40 are mounted together with bolts 46 extending through each corner of the upper plate to threaded ends screwed into respective bores in the lower plate 42. The bolts 46 are fastened to the upper plate 44 with corresponding nuts 48.

The pneumatic drive 36 also comprises a first pressurized air conduit 50 extending into the pneumatic cylinder 39 through the upper plate 44 of the pneumatic drive frame 40 for receiving pressurized air to lower the lower portion of the actuator. In addition, the pneumatic drive 36 includes a second pressurized air conduit 52 extending into the pneumatic cylinder 39 through the lower plate 42 of the pneumatic drive frame 40 for receiving pressurized air to raise the lower portion of the actuator 26. The pneumatic cylinder 39 reciprocates a shaft 54 which extends through a bore 56 in the lower panel 37 of the L-shape mounting bracket 34. The shaft 54 extends from the pneumatic cylinder 39 to a lower actuator frame 58 which is, in turn, reciprocated by the shaft.

The lower frame 58 of the actuator 26 comprises a suspension plate 60 connected to the pneumatic drive shaft 54 and a mounting bar 62 extending below the suspension plate for mounting the lower portion of the actuator. Guide shafts 64 extend from opposite ends of the suspension plate 60 through corresponding bores 66 in the lower plate 42 of the pneumatic drive frame 40. Threaded ends 68 of the guide shafts 64 are set in corresponding bores 70 in the suspension plate 60, but the remaining portions of the guide shafts 64 are free to reciprocate freely through the bores in the lower plate 42 of the pneumatic drive frame 40.

The actuator 26 further comprises an actuator casing 72 mounted to the mounting bar 62 of the lower frame 58. The actuator casing 72 includes a rearward section 74 fixed to the mounting bar 62, an upper frontal section 75 fixed to the rearward section with set screws 77, and a lower frontal section 78 fixed to the rearward section with additional set screws 79.

Figure 5:
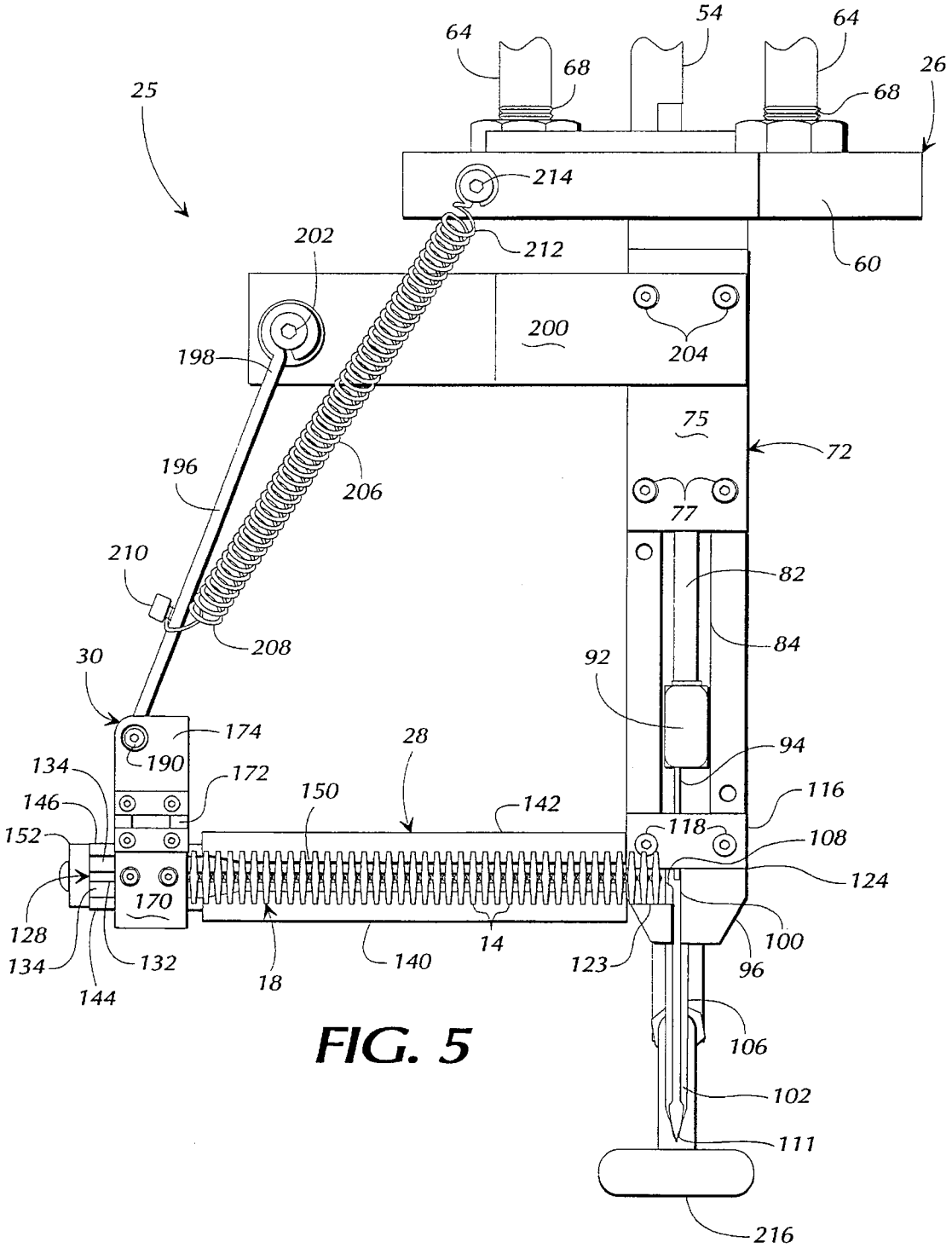
FIG. 5 is a partial frontal elevation view of the embodiment shown in FIG. 3 illustrating the interior of the actuator casing and the fastener magazine.

As best sown in FIG. 5, the upper frontal section 75 of the actuator casing 72 houses a second pneumatic cylinder 80 for reciprocating a shaft 82 through a plunger passage 84 extending along a longitudinal axis of the actuator casing. Upper and lower pressurized air conduits 86 and 88 extend through the upper frontal section 75 of the actuator casing 72 to provide pressurized air for operating the pneumatic cylinder 80.

The shaft 82 driven by the second pneumatic cylinder 80 reciprocates a plunger slide 92 which is disposed in the plunger passage 84. Likewise, the plunger slide 92 reciprocates a plunger 94 in a direction substantially parallel to the longitudinal axis of the actuator casing 72.

The actuator casing 72 has a lower end 96 which includes a recess 98 through which the plunger 94 passes to a channel 100 which also extends in a direction substantially parallel to the longitudinal axis of the actuator casing 72. A hollow slotted needle 102 is mounted in the channel 100 at the lower end 96 of the actuator casing 72 and extends below the actuator casing.

Figure 6:
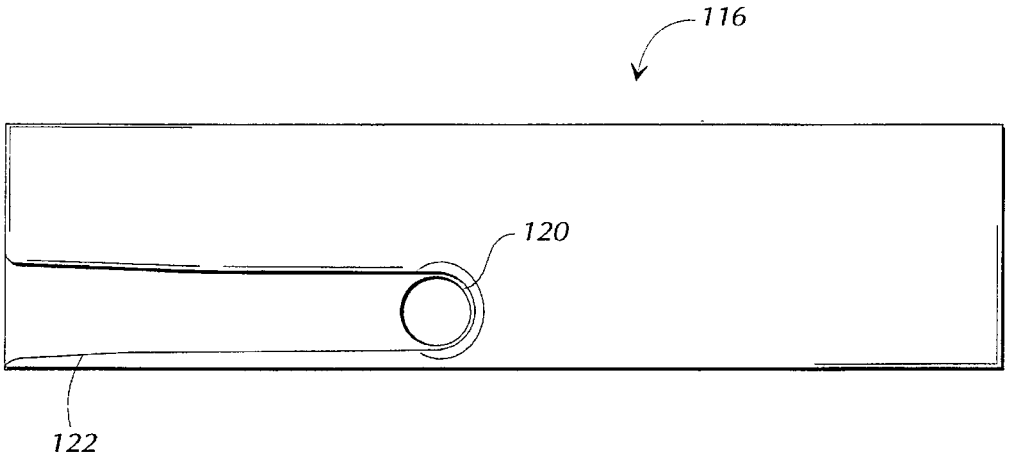
FIG. 6 is a perspective view of a hollow slotted needle which forms part of the dispensing apparatus shown in FIG. 3.

As shown in FIG. 6, the hollow slotted needle 102 has an elongate annular slotted passage 104 and a slot 106, both of which extend along a longitudinal axis substantially parallel with the longitudinal axis of the actuator casing 72. The hollow needle 102 extends from an inlet 108 in the head 109 of the needle to an outlet 110 at the tip 111 of the needle. The hollow needle 102 further has a notch 112 in the head 109 of the needle for receiving the first head 12 of each fastener 10 as will be explained in more detail below. The hollow needle 102 is fastened within the channel 100 with a set screw extending through the lower end 96 of the actuator casing 72.

Figure 7:
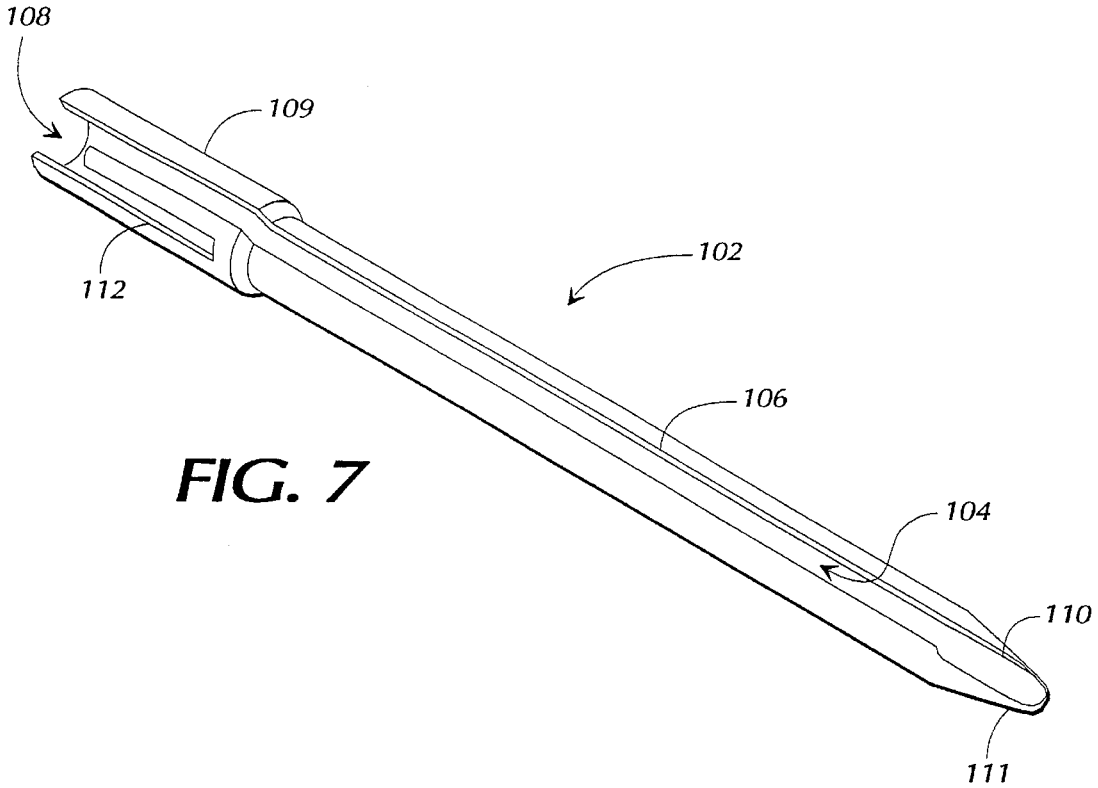
FIG. 7 is a plan view of the plunger guide block of the dispensing apparatus shown in FIG. 3.

A plunger guide plate 116 is disposed in the recess 98 at the lower end 96 of the actuator casing 72. The plunger guide plate 116 is best shown in FIG. 7 and is fixed to the actuator casing 72 with screws 118. A bore 120 for receiving the reciprocating plunger 94 extends through the plunger guide plate 116 and a V-shape notch 122 in the plunger guide plate 116 guides the first heads 12 of the fasteners 10 through the bore 120 of the plunger guide plate 116 and the notch 112 in the head 109 of the hollow needle 102. The recess 98 in the lower end 96 of the actuator casing 72 and the notch 122 in the plunger guide plate 166 from a port 123 in the lower end of the actuator casing for receiving the first heads 12 of the fasteners 10 from the magazine 28. An annular slotted passage 124 having a slot 125 extends through the lower end 96 of the actuator casing 72 at the port 123 substantially perpendicularly to the longitudinal axis of the actuator casing. This annular slotted passage 124 receives the runner bar 20 of the fastener stock 18 as the fastener stock is fed through the actuator 26 such that the severable necks 22 of the fasteners protrude through the slot 125 in this annular slotted passage.

Figure 8:
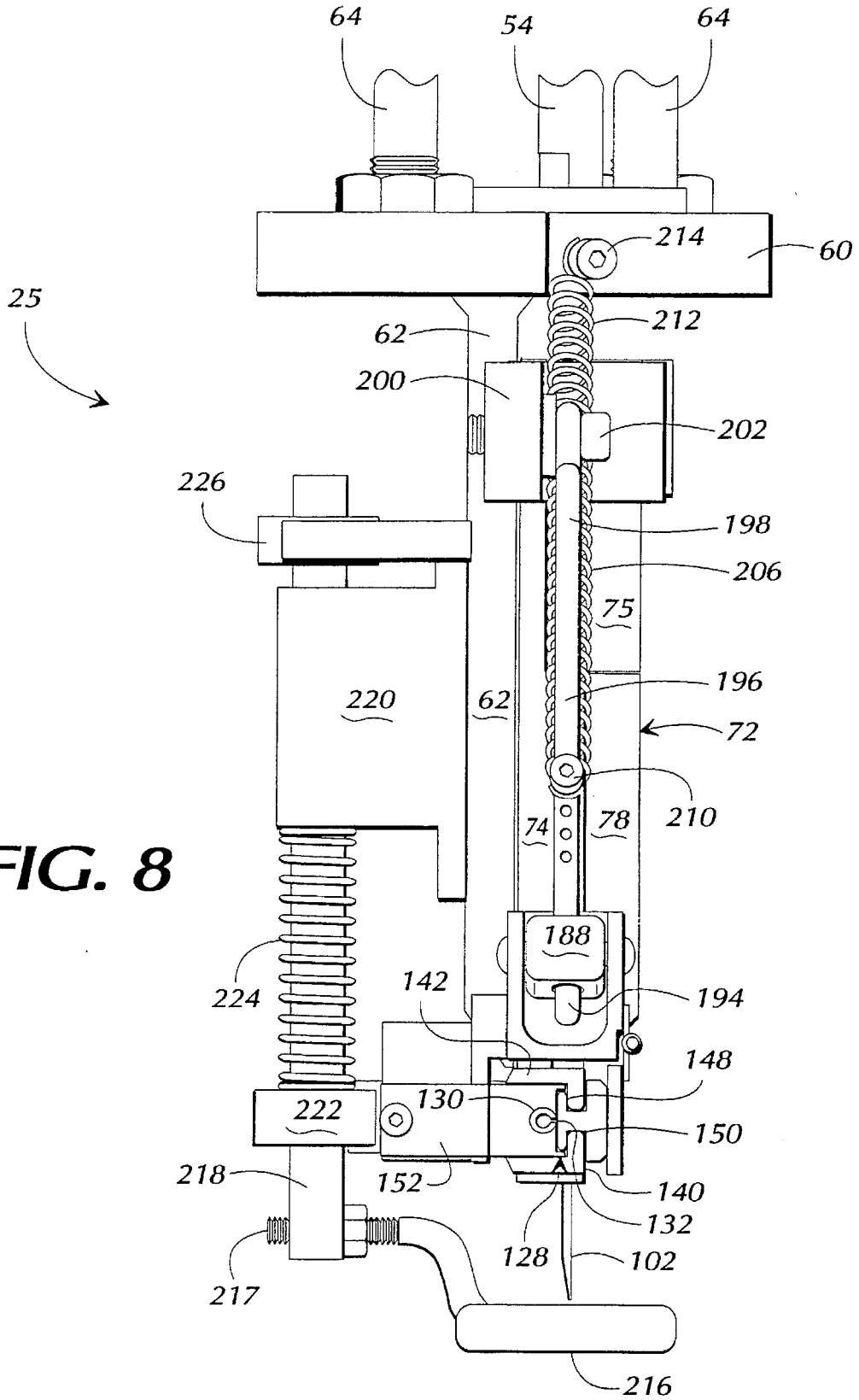
FIG. 8 is a partial end elevation view of the dispensing apparatus shown in FIG. 3 illustrating the magazine and slide assembly.
Figure 9:
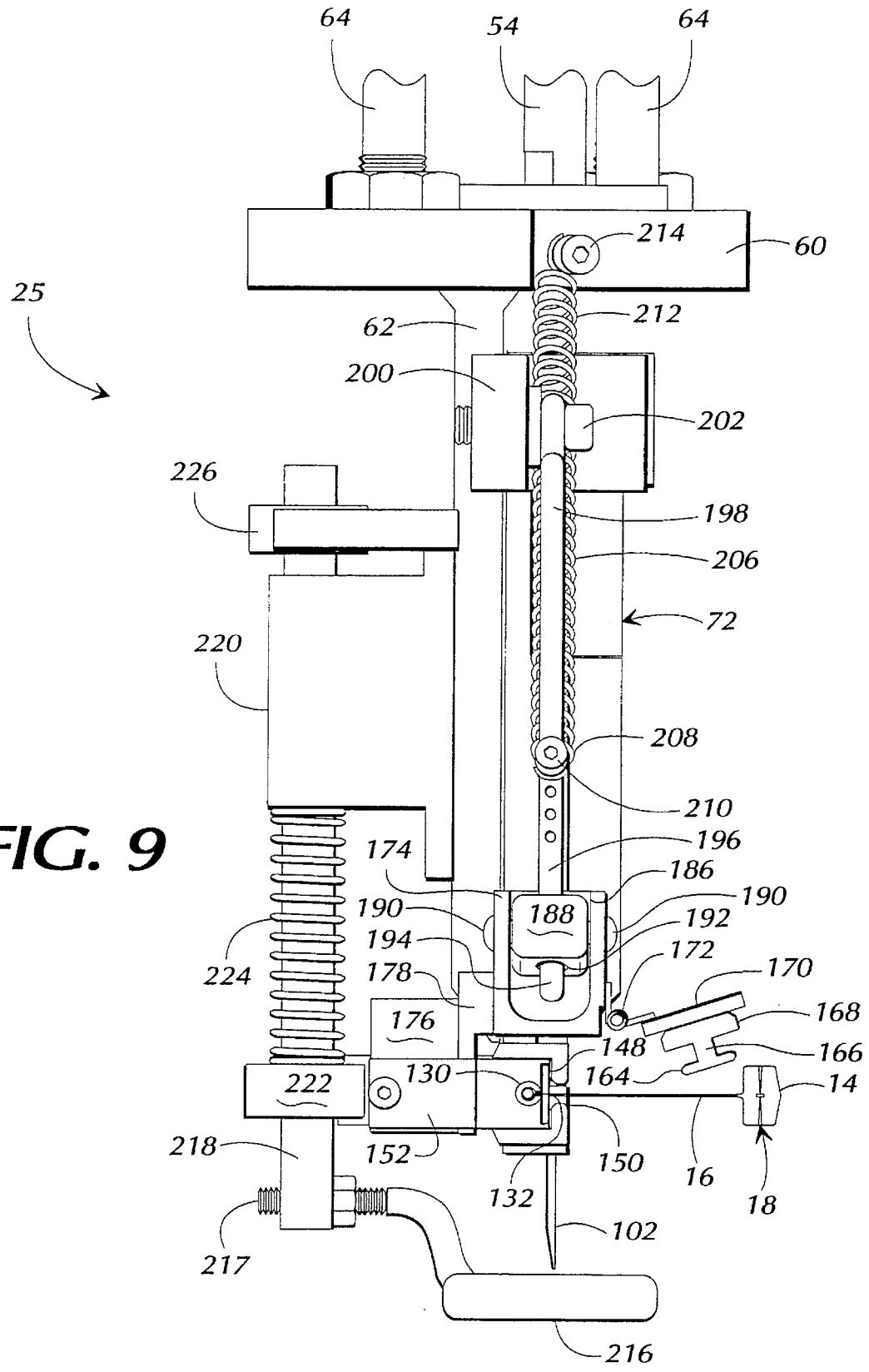
FIG. 9 is a partial end elevation view of the dispensing apparatus shown in FIG. 3 illustrating the fastener stock in the magazine.

As best shown in FIGS. 5, 8, and 9, the magazine 28 comprises an elongate guide member 126 extending laterally from the actuator casing 72 at the port 123 of the actuator casing and defines a chute 128 for guiding the dual head fasteners 10 from the fastener stock 18 to the inlet 108 of the hollow slotted needle 102. The chute 128 has an elongate annular slotted passage 130 which is aligned with the annular slotted passage 124 extending through the lower end 96 of the actuator casing 72 at the actuator casing port 123.

The annular slotted runner passage 130 of the magazine 28 has a slot 132 that opens through a planar surface 134 in the elongate guide member 126 of the magazine 128. The elongate guide member 126 further has a pair of side walls 136 and 138 extending along opposite edges of the planar surface 134. The side walls 136 and 138 in conjunction with L-shaped side members 140 and 142 extending along the sides 144 and 146 of the guide member 126 define a slotted head passage 148 having a rectangular cross section and a slot 150. The slotted head passage 148 is aligned and in communication with the port 123 in the lower end 96 of the actuator casing 72.

When a fastener stock 18 is fed through the magazine 28, the runner bar 20 passes through the annular slotted runner passage 130 in the chute 128 of the guide member 126 and the annular slotted runner passage 124 in the lower end 96 of the actuator casing 72. The severable necks 22 of the fastener stock 18 protrude through the slots 132 and 125 in the annular slotted runner passages. The heads of twelve of the fasteners 10 on the fastener stock 18 pass through the rectangular slotted head passage in the magazine 28, through the port 123 in the lower end 96 of the actuator casing 72 and the notch 112 in the needle head 109, to the inlet 108 of the needle 102. The filaments 16 of the fasteners 10 protrude through the slot 150 in the rectangular slotted head passage of the magazine 28 to the second heads 14 of the fasteners.

Figure 10:
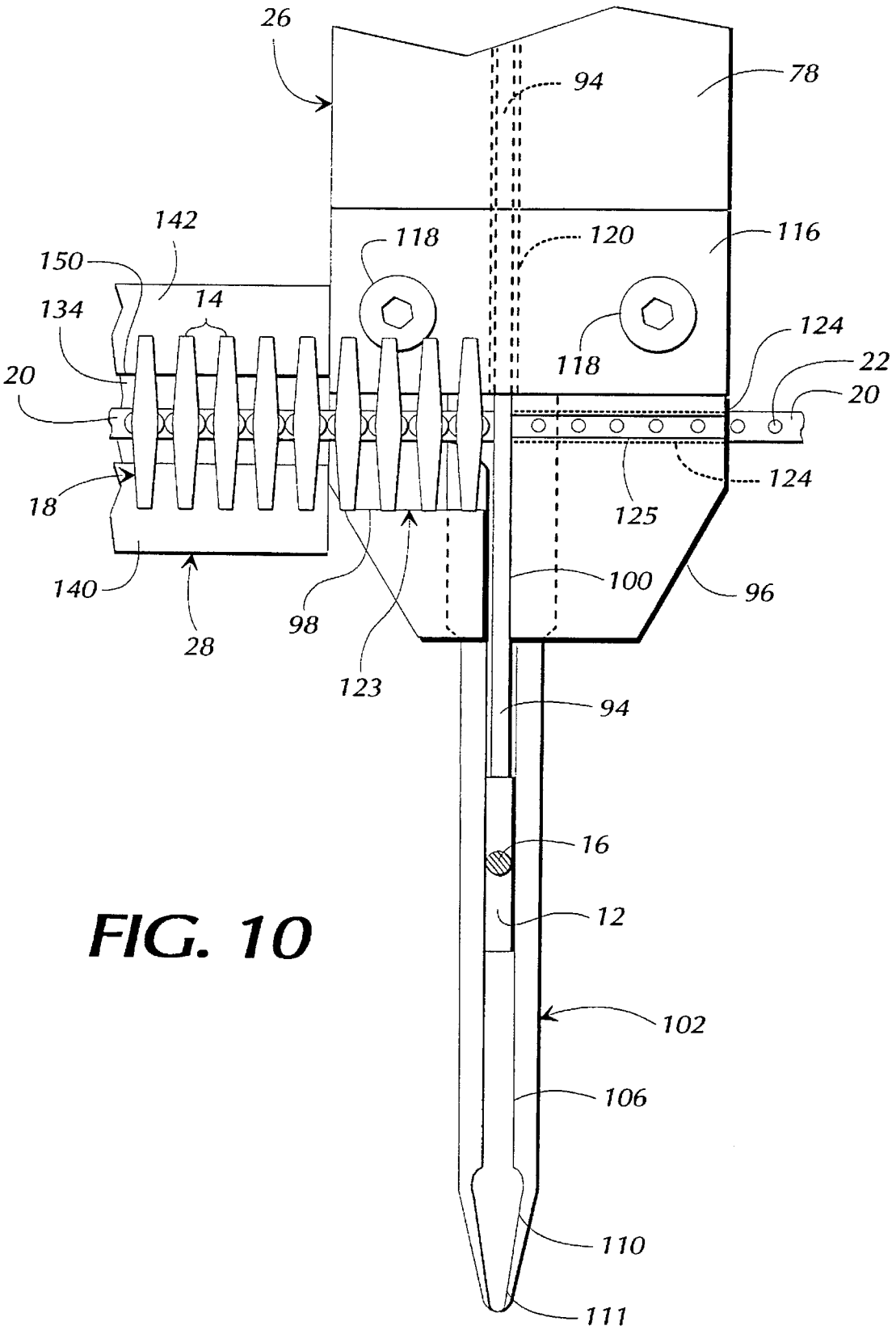
FIG. 10 is a partial elevation view of the lower portion of the casing which forms part of the dispensing apparatus shown in FIG. 3. This figure illustrates the dispensing of the fasteners. For purposes of illustration, the second heads of the fasteners are broken away to illustrate the action of the plunger against the first heads of the fasteners.

When dispensing of a fastener 10 is desirable, the actuator 26 is activated and drives the plunger 94 against the first head 12 of the fastener 10 positioned at the inlet 108 of the hollow needle 102 and drives the first head of that fastener through the slotted needle passage 104, severing the respective severable neck 122 from the runner bar 20, dispensing the fastener through the outlet 110 of the needle, and implanting the fastener in a workpiece. This operation is best illustrated in FIG. 10.

The magazine 28 further comprises a pair of L-shaped brackets 152 and 154 extending from opposite ends of the guide member 126 opposite the chute 128. A guide rod 156 extends between the L-shaped brackets 152 and 154. The guide rod 156 guides the slide assembly 30 as the slide assembly moves back and forth along the magazine 28.

The slide assembly 30 comprises a slide 158 carried by a carriage 160 and a spring drive mechanism 162 for moving the carriage and slide along the magazine 28.

The slide 158 comprises a foot 164 which can be slidingly received within the rectangular slotted head passage 148, a neck 166 projecting from the foot 164 through the slot 150 extending along the rectangular slotted head passage, and a head 168 extending from the neck opposite the foot. The head is attached to a plate 170 with set screws and the plate is attached to the carriage 160 with a hinge 172. The hinge 172 allows the slide 158 to be lifted from the magazine 28 when the foot 164 is removed from the rectangular slotted head passage 148 to load the magazine chute 128 with a fastener stock 18 as shown in FIG. 9.

The carriage 160 comprises a hollow carriage frame 174 to which the hinge 172 is attached, and a guide block 176 connected to the carriage frame opposite the slide 158 with a connecting plate 178. The guide block 176 has a bore (not shown) extending therethrough for slidably receiving the guide rod 156. The slide assembly 30 is guided by the guide rod 156 along the magazine 28. The guide block 176 is attached to the connecting plate 178 with screws and the connecting plate 178 is attached to the carriage frame 174 with screws.

The carriage frame 174 has a central opening 176 and a pivotable bearing 188 disposed in the central opening between pins 190 about which the bearing rotates. A bore 192 extends through the pivotal bearing 188 and one end 94 of a lever arm 196 extends freely through the bore. The other end 198 of the lever arm 196 is pivotally mounted to a mounting bar 200 with a pivot pin 202. The mounting bar 200 is mounted to the upper frontal section 75 of the actuator casing with set screws 204 and extends above and substantially parallel to the magazine 28 to the other end 198 of the lever arm 196.

A spring 206 is connected at one end to the lever arm 196 between the ends 194 and 198 of the lever arm with a pin 210 and at another end 212 to the suspension plate 60 of the actuator 26 with another pin 214. The spring 206 extends from the lever arm 196 to the suspension plate 60 of the actuator 26 at an acute angle to the lever arm in an upward direction away from the magazine 28. The spring 206 forces the foot 164 of the slide 158 through the rectangular slotted head passage 150 and against the fastener stock 18 in that passage and forces the fasteners 10 into the actuator casing 72 for dispensing the fasteners through the hollow slotted needle 102. This configuration of the lever arm 196 and the spring 206 allows the slide assembly 30 to exert a substantially uniform force to the fastener stock 18 along the length of the magazine 28.

The presser foot assembly 32 comprises a ring-shaped presser foot 216 attached at a threaded end 217 to the lower end of a shaft 218. The shaft 218 is slidingly engaged within a cylinder 220 mounted to the mounting bar 62 of the lower frame 58 of the actuator 26 and can reciprocate within the cylinder. A lower detente 222 is positioned on the shaft 218 proximate the presser foot 216 and a spring 224, coiled around the shaft, extends between the lower detente and the cylinder 220. The spring 224 biases the presser foot 216 in an extended lower position. An upper detente 226 is fixed to the end of the shaft 218 opposite the presser foot 216 to hold the shaft within the cylinder 220.

The fastener dispenser 25 is useful to apply dual head fasteners to a variety of objects including textiles such as mats, rugs, towels, articles of clothing, and the like. To operate the fastener dispenser 25, the dispenser is mounted in a stationary position, preferably above a work table, with the presser foot 216 being positioned just above an opening in the table. The opening in the table should have a size slightly less than the presser foot ring 216. A workpiece such as a mat is placed between the presser foot 216 and the table, and an article, such as a label, is placed on the mat beneath the presser foot. The desired area of the mat at which the fastener is to be applied is positioned beneath the presser foot 216 and the actuator 26 is lowered by activating the pneumatic cylinder 39 of the pneumatic drive 36. When the actuator 26 is lowered, the presser foot 216 presses against the workpiece and the actuator slides downwardly along the presser foot shaft 218 compressing the presser foot spring 224 until the needle 102 penetrates the workpiece. After the needle 102 penetrates the workpiece, the second pneumatic cylinder 80 is activated to lower the plunger 94 through the plunger passage 84, the bore 120 in the plunger guide plate 116, and against the first head 12 of the fastener 10 disposed in the inlet 108 of the needle 102. The plunger 94 forces the first head 12 of that fastener 10 through the slotted passage 104 of the needle, detaches the fastener from the fastener stock 18, dispenses the first head of a fastener out of the needle outlet 110, and implants the fastener in the workpiece. The plunger 94 is then raised above the inlet 108 of the needle 102 to allow the first head 12 of the next fastener 10 to enter the needle inlet and the first pneumatic cylinder is activated to raise the actuator 26 and needle above the workpiece so that another workpiece may be positioned beneath the dispenser.

In some applications, it is desirable to use multiple fastener dispensers on a single workpiece. In such a case, the appropriate number of dispensers can be mounted in the desired positions and may be operated simultaneously. The fastener dispenser of the present invention can be operated by a push button or a foot pedal machine.

It should be understood that the foregoing relates to a particular embodiment of this invention, and that numerous changes may be made therein without departing from the scope of the invention as defined by the following claims.

I claim:

1. Apparatus for dispensing dual head fasteners from a fastener stock comprising a plurality of the fasteners, the fasteners comprising a first head, a second head, and a filament connecting the first and second heads so that the first and second heads are substantially parallel to one another and the filament is substantially perpendicular to the first and second heads, the fastener stock comprising a runner bar having a longitudinal axis, each of the fasteners removably attached to the runner bar with severable necks connecting respective first heads of the fasteners to the runner bar opposite the filaments so that (1) the fasteners extend outwardly from the runner bar substantially parallel with one another and substantially perpendicular to the runner bar, (2) the first heads are side-by-side and have longitudinal axes substantially perpendicular to the longitudinal axis of the runner bar, and (3) the second heads are side-by-side, the apparatus comprising:

an actuator comprising:

a casing having a longitudinal axis, a plunger passage extending along the longitudinal axis of the casing, a fastener port proximate one end of the casing for receiving the first heads of the fasteners;

a hollow slotted needle having an elongate slotted needle passage, the needle passage having a slot extending along the needle passage, an inlet and an outlet, the needle fixed to the casing so that the inlet of the needle communicates with the port and the needle extends from the one end of the casing toward the needle outlet along a longitudinal axis substantially parallel to the longitudinal axis of the casing;

a plunger disposed in the plunger passage and extendable into the slotted passage of the needle for reciprocation within the plunger passage and slotted needle passage; and means for reciprocating the plunger;

a magazine for feeding fasteners from the fastener stock to the inlet of the hollow slotted needle comprising an elongate guide member extending laterally from the actuator casing at the port and defining a chute having an elongate slotted runner passage for receiving the runner bar of the fastener stock and an elongate slotted head passage for receiving the first heads of the fasteners, the slotted runner passage of the magazine being in communication with the port and having a slot through which the severable necks of the fastener stock project, and the slotted head passage being in communication with the port of the casing and having a slot through which the filaments of the fasteners project; and a slide assembly comprising:

a slide including a foot selectively and slidably engagable in the slotted head passage and alternatively removable from the slotted head passage; and a spring for forcing the foot through the slotted head passage and against the fastener stock to force the fasteners into the casing port for dispensing fasteners through the hollow slotted needle.

2. Apparatus as in claim 1 wherein the casing has an elongate slotted runner passage having a slot and extending through the casing at the port substantially perpendicularly to the longitudinal axis of the casing for receiving the runner bar of the fastener stock such that the severable necks protrude through the slot of the slotted runner passage in the casing.

3. Apparatus as in claim 1 wherein the slotted needle passage is annular, the slotted runner passage of the magazine is annular, the slotted head passage is substantially rectangular in cross-section, and the first head of each fastener comprises an elongate bar.

4. Apparatus as in claim 2 wherein the slotted needle passage is annular, the slotted runner passage of the magazine is annular, the slotted head passage is substantially rectangular in cross-section, the slotted runner passage of the casing is annular, and the first head of each fastener comprises an elongate bar.

5. Apparatus as in claim 1 wherein the plunger reciprocating means comprises a pneumatic means.

6. Apparatus as in claim 1 wherein the actuator further comprises a frame for stationary mounting of the casing and means for reciprocating the casing and the hollow needle relative to the frame for penetrating a workpiece with the needle.

7. Apparatus as in claim 6 wherein the casing and needle reciprocating means comprises a pneumatic means.

8. Apparatus as in claim 1 wherein the slot of the slotted runner passage of the magazine is sized so as to prevent the runner bar of the fastener stock from passing out of the slotted runner passage of the magazine through the slot in the slotted runner passage of the magazine.

9. Apparatus as in claim 1 wherein the slotted head passage is sized so as to prevent the foot of the slide assembly from passing out of the slotted head passage through the slot of the head passage.

10. Apparatus as in claim 1 wherein the spring is connected at one end to the actuator and at another end to the fastener slide assembly.

11. Apparatus as in claim 1 wherein the slide further comprises a neck which projects through the slot of the slotted head passage when the foot is engaged in the slotted head passage, and the slide assembly further comprises a carriage for carrying the slide as the slide is moved through the slotted head passage, the neck of the slide being connected to the carriage.

12. Apparatus as in claim 11 wherein the magazine further comprises (a) a pair of brackets extending from the elongate guide member spaced from one another and opposite the chute, and (b) a guide bar extending between the brackets, wherein the guide bar is slidably engaged with the carriage for guiding the carriage as the carriage moves along the magazine.

13. Apparatus as in claim 12 wherein the carriage further comprises a pivotable bearing and a lever arm pivotally mounted at one end to the actuator and extending through a bore in the pivotable bearing to another end, the spring being attached at the one end to the actuator and at the other end to the lever arm between the ends of the lever arm so that the spring forces the lever arm, carriage, and slide towards the actuator.

14. Apparatus as in claim 13 wherein the slide is connected to the carriage with a hinge so that the slide can be lifted away from the magazine for loading a fastener stock in the magazine.

15. Apparatus as in claim 13 wherein the spring extends from the lever arm to the actuator at an acute angle to the lever arm and in a direction away from the magazine.

16. Apparatus as in claim 1 further comprising a presser foot mounted to the actuator casing and comprising a ring positioned so that the hollow slotted needle passes through the ring when the needle is reciprocated.

17. Apparatus as in claim 16 wherein the presser foot further comprises a cylinder mounted to the actuator casing, a shaft slidably engaged in the cylinder and extending from the cylinder to an end connected to the ring, and a spring through which the shaft extends for biasing the ring away from the actuator.

18. Apparatus for dispensing dual head fasteners from a fastener stock comprising a plurality of the fasteners, the fasteners comprising a first head, a second head, and a filament connecting the first and second heads so that the first and second heads are substantially parallel to one another and the filament is substantially perpendicular to the first and second heads, the fastener stock comprising a runner bar having a longitudinal axis, each of the fasteners removably attached to the runner bar with severable necks connecting respective first heads of the fasteners to the runner bar opposite the filaments so that (1) the fasteners extend outwardly from the runner bar substantially parallel with one another and substantially perpendicular to the runner bar, (2) the first heads are side-by-side and have longitudinal axes substantially perpendicular to the longitudinal axis of the runner bar, and (3) the second heads are side-by-side, the apparatus comprising:

an actuator comprising:

a casing having a longitudinal axis, a plunger passage extending along the longitudinal axis of the casing, a fastener port proximate one end of the casing for receiving the first heads of the fasteners;

a hollow slotted needle having an elongate slotted needle passage, the needle passage having a slot extending along the needle passage, an inlet and an outlet, the needle fixed to the casing so that the inlet of the needle communicates with the port and the needle extends from the one end of the casing toward the needle outlet along a longitudinal axis substantially parallel to the longitudinal axis of the casing;

a plunger disposed in the plunger passage and extendable into the slotted passage of the needle for reciprocation within the plunger passage and slotted needle passage; and means for reciprocating the plunger;

a magazine for feeding fasteners from the fastener stock to the inlet of the hollow slotted needle comprising:

an elongate guide member extending laterally from the actuator casing at the port and defining a chute in communication with the port for receiving the fasteners;

a pair of brackets extending from the elongate guide member spaced from one another and opposite the chute; and a guide bar extending between the brackets; and a slide assembly comprising:

a slide including a foot selectively and slidably engagable in the chute and alternatively removable from the chute;

a carriage for carrying the slide as the slide is moved through the chute, the guide bar being slidably engaged with the carriage for guiding the carriage as the carriage moves along the magazine; and a spring for forcing the foot through the chute and against the fastener stock to force the fasteners through the chute and into the casing port for dispensing fasteners through the hollow slotted needle.

19. Apparatus as in claim 18 wherein the carriage further comprises a pivotable bearing and a lever arm pivotally mounted at one end to the actuator and extending through a bore in the pivotable bearing to another end, the spring being attached at the one end to the actuator and at the other end to the lever arm between the ends of the lever arm so that the spring forces the lever arm, carriage, and slide towards the actuator.

20. Apparatus as in claim 19 wherein the slide is connected to the carriage with a hinge so that the slide can be lifted away from the magazine for loading a fastener stock in the magazine.

21. Apparatus as in claim 19 wherein the spring extends from the lever arm to the actuator at an acute angle to the lever arm and in a direction away from the magazine.

22. Apparatus for dispensing dual head fasteners which comprise a first head, a second head, and a filament connecting the first and second heads so that the first and second heads are substantially parallel to one another and the filament is substantially perpendicular to the first and second heads, the apparatus comprising:

an actuator comprising:

a casing having a longitudinal axis, a plunger passage extending along the longitudinal axis of the casing, a fastener port proximate one end of the casing for receiving the first heads of the fasteners;

a hollow slotted needle having an elongate slotted needle passage, the needle passage having a slot extending along the needle passage, an inlet and an outlet, the needle fixed to the casing so that the inlet of the needle communicates with the port and the needle extends from the one end of the casing toward the needle outlet along a longitudinal axis substantially parallel to the longitudinal axis of the casing;

a plunger disposed in the plunger passage and extendable into the slotted passage of the needle for reciprocation within the plunger passage and slotted needle passage; and means for reciprocating the plunger for dispensing fasteners through the hollow slotted needle;

a frame for stationary mounting of the casing;

means for reciprocating the casing and the hollow needle relative to the frame for penetrating a workpiece with the needle; and a presser foot mounted to the actuator casing and comprising a ring positioned so that the hollow slotted needle passes through the ring when the needle is reciprocated.

23. Apparatus as in claim 22 wherein the plunger reciprocating means comprises a pneumatic means.

24. Apparatus as in claim 22 wherein the casing and needle reciprocating means comprises a pneumatic means.

25. Apparatus as in claim 22 wherein the presser foot further comprises a cylinder mounted to the actuator casing, a shaft slidably engaged in the cylinder and extending from the cylinder to an end connected to the ring, and a spring through which the shaft extends for biasing the ring away from the actuator.

* * * * *